US006347265B1

(12) United States Patent
Bidaud

(10) Patent No.: US 6,347,265 B1
(45) Date of Patent: Feb. 12, 2002

(54) RAILROAD TRACK GEOMETRY DEFECT DETECTOR

(75) Inventor: Andre C. Bidaud, Burnaby (CA)

(73) Assignee: Andian Technologies Ltd., Burnaby (CA)

( * ) Notice: Subject to any disclaimer, the term of this patent is extended or adjusted under 35 U.S.C. 154(b) by 0 days.

(21) Appl. No.: 09/594,286

(22) Filed: Jun. 15, 2000

Related U.S. Application Data

(60) Provisional application No. 60/139,217, filed on Jun. 15, 1999, and provisional application No. 60/149,333, filed on Aug. 17, 1999.

(51) Int. Cl.[7] ..... B61L 23/04
(52) U.S. Cl. ..... 701/19; 73/146
(58) Field of Search ..... 701/19; 73/146

(56) References Cited

U.S. PATENT DOCUMENTS 3,638,482 A * 2/1972 Schubert ..... 73/146
4,005,601 A * 2/1977 Botello ..... 73/146
4,691,565 A * 9/1987 Theurer ..... 73/146
4,741,207 A * 5/1988 Spangler ..... 73/146
4,793,577 A * 12/1988 Austill et al. ..... 246/107
4,880,190 A * 11/1989 Austill et al. ..... 246/107
5,440,923 A 8/1995 Arnberg et al.
5,956,664 A * 9/1999 Bryan ..... 702/184
5,987,979 A * 11/1999 Bryan ..... 73/146
6,044,698 A * 4/2000 Bryan ..... 73/146
6,125,311 A * 9/2000 Lo ..... 701/29

FOREIGN PATENT DOCUMENTS

FR 0561705 A1 * 9/1993 ..... B61L/25/02

* cited by examiner

*Primary Examiner*—Michael J. Zanelli
*Assistant Examiner*—Eric M Gibson
(74) *Attorney, Agent, or Firm*—Fay, Sharpe, Fagan, Minnich & McKee, LLP

(57) ABSTRACT

A track analyzer included on a vehicle traveling on a track includes a vertical gyroscope for determining a grade and an elevation of the track. A rate gyroscope determines a curvature of the track. A speed determiner determines a speed of the vehicle relative to the track. A distance determiner determines a distance the vehicle has traveled along the track. A computing device, communicating with the vertical gyroscope, the rate gyroscope, the speed determiner, and the distance determiner, a) identifies a plurality of parameters as a function of the grade, elevation, and curvature of the track, b) determines in real-time if the parameters are within acceptable tolerances, and, c) if the parameters are not within the acceptable tolerances, generates corrective measures.

17 Claims, 5 Drawing Sheets

FIG. 1
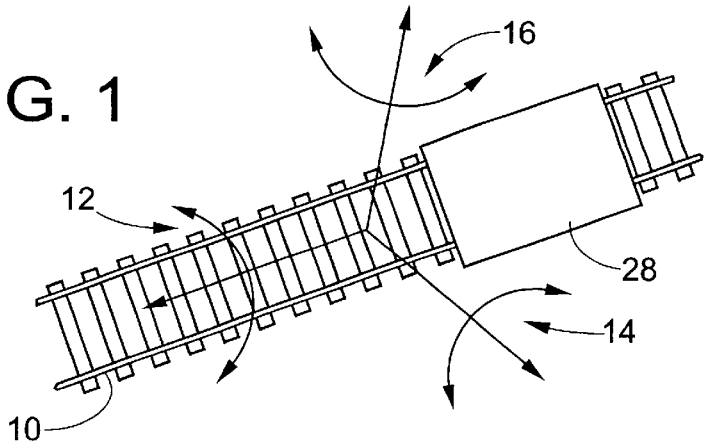
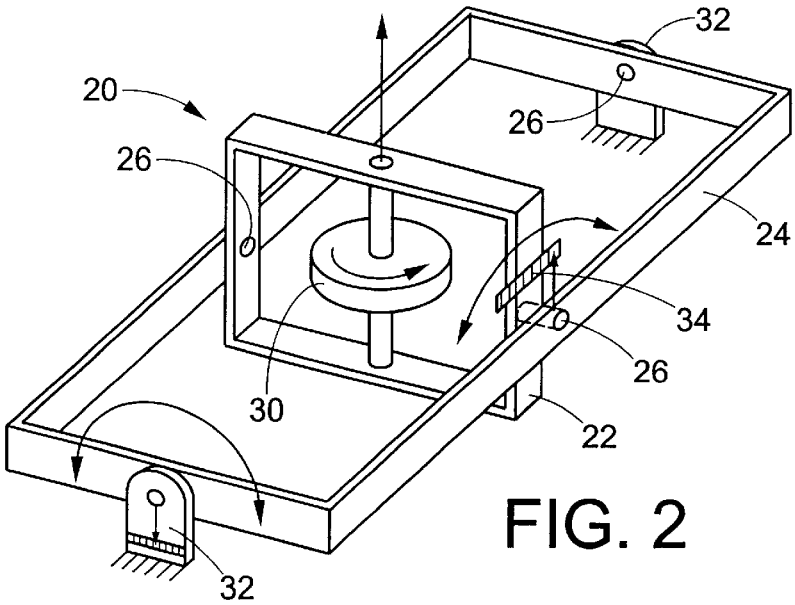
FIG. 2
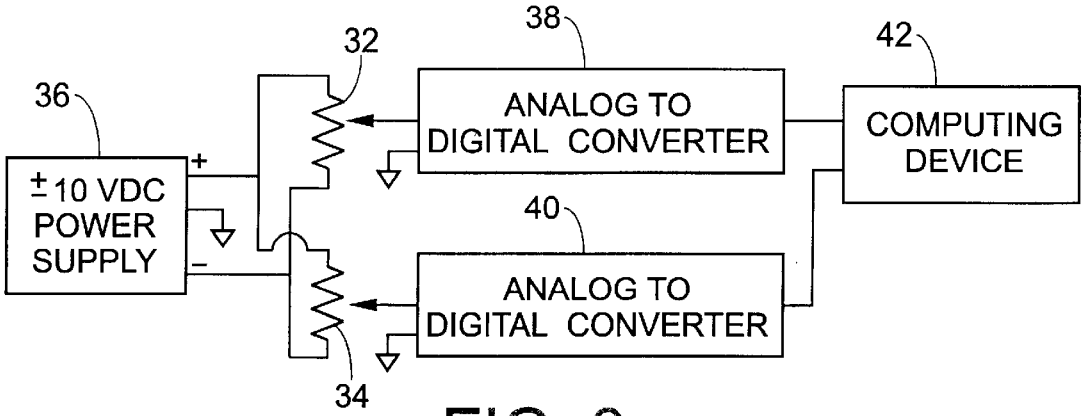
FIG. 3

RAILROAD TRACK GEOMETRY DEFECT DETECTOR

This application claims the benefit of U.S. Provisional Application Nos. 60/139,217, filed Jun. 15, 1999, and 60/149,333, filed Aug. 17, 1999.

BACKGROUND OF THE INVENTION

The present invention relates to determining and recording a geometry of a railroad track. It finds particular application in conjunction with determining and recording a geometry of a railroad track for a vehicle riding on the track and will be described with particular reference thereto. It will be appreciated, however, that the invention is also amendable to other like applications.

Heretofore, track geometry systems determine and record geometries of railroad tracks used by railroad cars. Each railroad car includes a body secured to a truck, which rides on the track. Conventional systems use a combination of inertial and contact sensors to indirectly measure and quantify the geometry of the track. More specifically, an inertial system mounted on a railroad car senses a motion of the car's body. A plurality of transducers measure a relative motion of the car's body to the truck. Similarly, other transducers measure a relative motion of the truck to the track.

One drawback of conventional systems is that a significant number of errors occur from transducer failures. Furthermore, significant errors also result from a lack of direct measurements of the required quantities.

Furthermore, conventional inertial systems typically use off-the-shelf gyroscopes and other components, which are designed for military and aviation applications. Such off-the-shelf components are designed for high rates of inertial change found in military and aircraft applications. Therefore, components used in conventional systems are poorly suited for the relatively low amplitude and slow varying signals seen in railroad applications. Consequently, conventional systems compromise accuracy in railroad applications.

Furthermore, no current device or system allows for the inspection of rail track structures, such that determinations of track safety is determined in real time.

The present invention provides a new and improved apparatus and method which overcomes the above-referenced problems and others.

SUMMARY OF THE INVENTION

A track analyzer included on a vehicle traveling on a track includes a vertical gyroscope for determining a grade and an elevation of the track. A rate gyroscope determines a curvature of the track. A speed determiner determines a speed of the vehicle relative to the track. A distance determiner determines a distance the vehicle has traveled along the track. A computing device, communicating with the vertical gyroscope, the rate gyroscope, the speed determiner, and the distance determiner, a) identifies a plurality of parameters as a function of the grade, elevation, and curvature of the track, b) determines in real-time if the parameters are within acceptable tolerances, and, c) if the parameters are not within the acceptable tolerances, generates corrective measures.

In accordance with one aspect of the invention, a video display device communicates with the computing device. The corrective measures include messages displayed on the video display device.

In accordance with another aspect of the invention, an analog-to-digital converter converts analog signals from the vertical gyroscope, the rate gyroscope, the speed determiner, and the distance determiner into respective digital signals which are transmitted to the computing device.

In accordance with another aspect of the invention, the vertical gyroscope includes an inner gimbal, an outer gimbal, and a spin motor. The spin motor creates an inertial force. The grade and the elevation of the track are determined by motions of the inner and outer gimbals against the inertial force.

In accordance with a more limited aspect of the invention, the inner gimbal determines the grade of the track and the outer gimbal determines the elevation of the track.

In accordance with another aspect of the invention, a look-up table, which communicates with the computing device, stores the acceptable tolerances.

In accordance with a more limited aspect of the invention, the acceptable tolerances identify urgent defects and priority defects. The corrective measures include actions to be implemented substantially immediately for urgent defects and actions to not be implemented substantially immediately for priority defects.

In accordance with another aspect of the invention, the acceptable tolerances include curve elevation tolerances and maximum allowable runoff tolerances.

In accordance with another aspect of the invention, the speed determiner includes a toothed gear having teeth passing a sensor for inducing a voltage in a coil. A frequency of the voltage is proportional to a speed of the vehicle relative to the track.

One advantage of the present invention is that it allows inspection of rail track structures for determining track safety in real time.

Another advantage of the present invention is that direct measurements of the required quantities reduce the numbers of errors even more.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 1 illustrates a vehicle along a track according to the present invention;

FIG. 2 illustrates a vertical gyroscope according to the present invention;

FIG. 3 illustrates analog-to-digital converters according to the present invention;

DETAILED DESCRIPTION OF THE PREFERRED EMBODIMENTS

Figure 4:
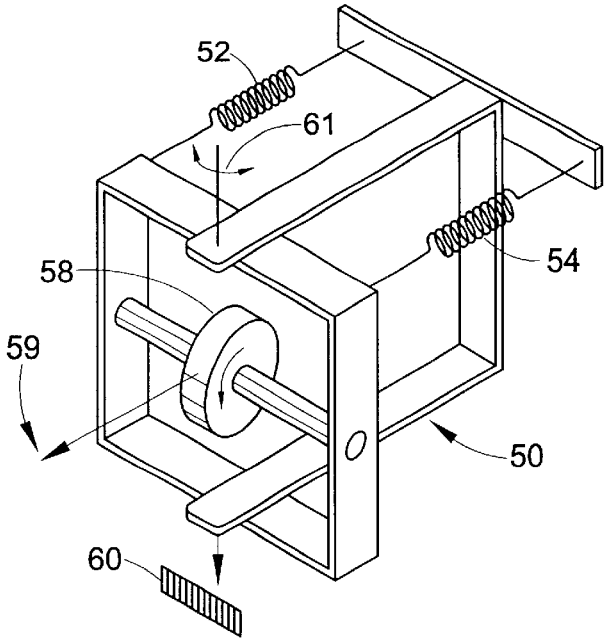
FIG. 4 illustrates a rate gyroscope according to the present invention.

With reference to FIG. 1, a track 10 may be defined by an roll axis 12, which measures a cross elevation (e.g., cross-level) of the track 10, a pitch axis 14, which measures a grade of the track 10, and a yaw axis 16, which measures a rate of curvature of the track 10.

With reference to FIGS. 1 and 2, a vertical gyroscope 20 ("gyro") includes an inner gimbal 22, which measures the pitch (e.g., grade) 14 and an outer gimbal 24, which measures the roll (e.g., cross elevation or cross-level) 12. Respective bearings 26 secure the inner and outer gimbals 22, 24, respectively, to a railroad vehicle (e.g., railroad car) 28 traveling along the track 10. The vertical gyro 20 includes a spin motor 30, which always remains substantially vertical. The spin motor 30 preferably spins at about 30,000 revolutions per minute ("rpm"). In this manner, the spin motor 30 acts as an inertial reference (e.g., axis). Any motion by the inner gimbal 22 and/or the outer gimbal 24 is measured against the inertial reference of the spin motor 30.

Although a vertical gyroscope has been described in the preferred embodiment, it is to be understood that any device, which has a spinning mass with a spin axis that turns between two low-friction supports and maintains an angular orientation with respect to inertial coordinates when not subjected to external torques, is contemplated. Furthermore, it is to be understood that non-mechanical gyroscopes are also contemplated.

With reference to FIGS. 2 and 3, analog electric signals are generated by first and second potentiometers 32, 34, respectively, which are preferably powered by a power supply 36 (e.g., a±10 VDC power supply). The first and second potentiometers 32, 34 are secured to the outer and inner gimbals 24, 22, respectively. The analog signals are transmitted to respective analog-to-digital converters 38, 40. The analog-to-digital converters 38, 40 transform the analog signals to corresponding digital signal representations. The digital signals are then transmitted to a computing device 42. In this manner first, second, and third channels represent the cross, grade, and curvature (rate) of the vehicle 28, respectively.

When setting up the system, it is important that the pitch axis 14 is substantially parallel to the rail track 10. Then, by default the roll axis 12 is substantially perpendicular to the longitudinal axis of the track 10.

With reference to FIG. 4, a rate gyroscope 50 includes first and second springs 52, 54, respectively. The springs 52, 54 give the rate gyro 50 a single degree of freedom around an axis of rotation located above a spin motor 58. A torque axis 59 is in a direction perpendicular to a gimbal axis 61 around which the spin motor 58 turns. A measurement potentiometer 60 detects displacement of the spin motor 58 from a reference line parallel to the torque axis 59. In the preferred embodiment, the rate gyroscope 50 is mounted on the vehicle 28 for measuring yaw 16 (see FIG. 1).

Figure 5:
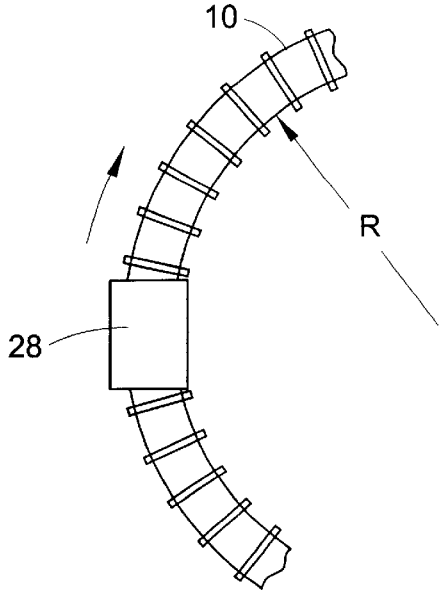
FIG. 5 illustrates a section of curved track according to the present invention.

More specifically, as long as the railroad car 28 is traveling straight, the forces on the springs 52, 54 are equal. Therefore, the torque axis remains parallel to the direction of travel. When the railroad car 28 travels through a curve, having a radius R, along the track 10 (see FIG. 5), the spin motor 58 and torque axis 59 tend to remain in the same direction as when the car 28 travels straight. In this manner, the rate gyro 50 measures a displacement from a reference line (e.g., a rate-of-change of displacement about an axis). The angle of rotation (displacement) about the gimbal axis 61 corresponds to a measure of the input angular rate (angular velocity).

Although a rate gyroscope has been described in the preferred embodiment, it is to be understood that any device, which has a spinning mass with a spin axis that turns between two low-friction supports and maintains an angular orientation with respect to inertial coordinates when not subjected to external torques, is contemplated. Furthermore, it is to be understood that non-mechanical gyroscopes are also contemplated.

Figure 6:
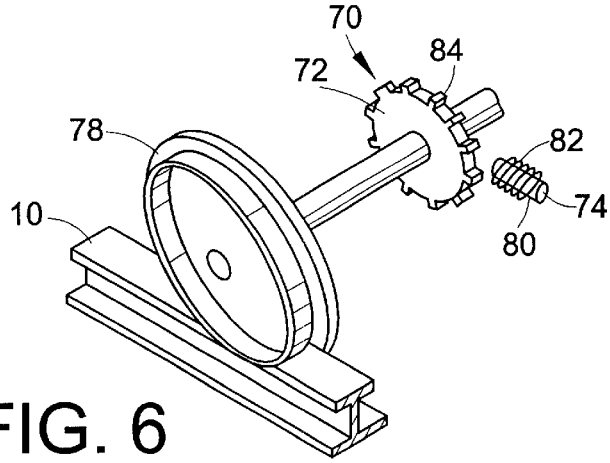
FIG. 6 illustrates a speed determiner according to the present invention.
Figure 7:
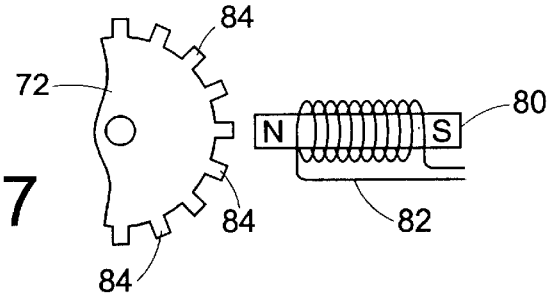
FIG. 7 illustrates a sensor according to the present invention.
Figure 8:
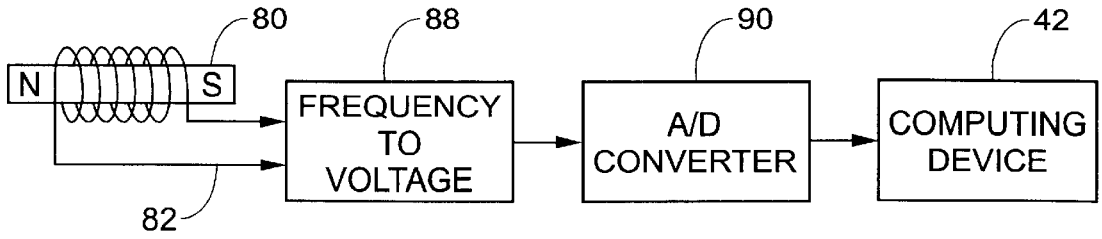
FIG. 8 illustrates a sensor according to the present invention.

With reference to FIG. 6, a speed determiner (e.g., a speedometer) 70, including a toothed gear 72 and a pick-up (sensor) 74, is connected to a free-spinning rail wheel 78 contacting the track 10. The free-spinning rail wheel 78 is chosen, as opposed to a driven wheel, to eliminate errors due to acceleration slippage or brake skidding.

With reference to FIGS. 1 and 6–8, the sensor 74 includes a magnet 80 and a pick-up coil 82, which acts as a sensor. As teeth 84 along the toothed gear 72 pass by the sensor 74, a back electromagnetic force (voltage) is induced into the pick-up coil 82. The voltage is in the form of a sine wave. The frequency of the voltage is proportional to the speed of the vehicle. The variable alternating current ("A.C.") voltage is transmitted from the magnet 80 and coil 82 to a frequency-to-voltage converter 88 (see FIG. 8). The frequency-to-voltage converter 88 produces a direct current ("D.C.") voltage proportional to the speed of the vehicle 28 traveling on the track 10. The D.C. voltage is transmitted to an analog-to-digital converter 90, which transforms the analog signals into a digital format. The digital signals are then transmitted to the computing device 42 for processing.

Figure 9:
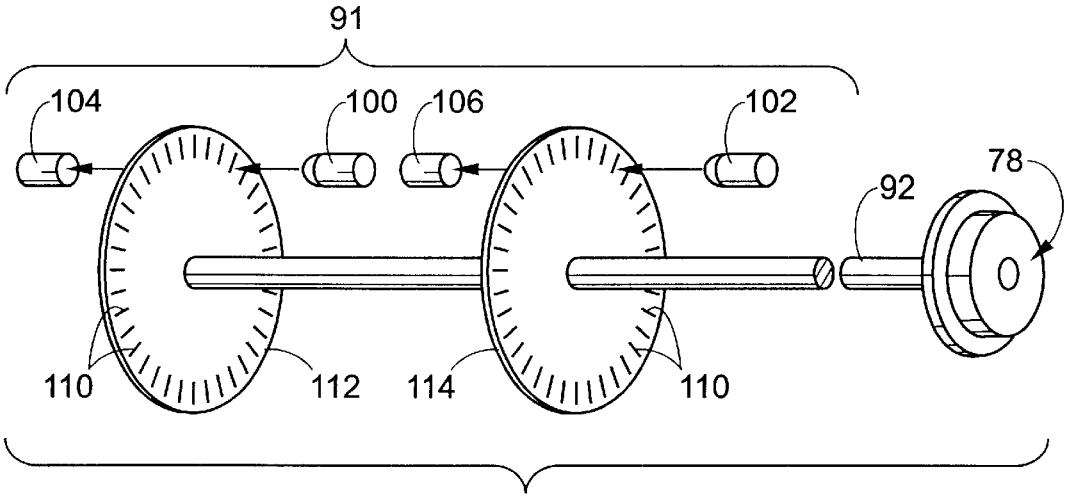
FIG. 9 illustrates a distance determiner according to the present invention.
Figure 10:
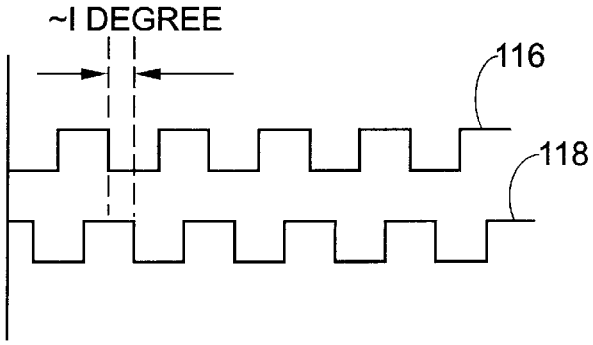
FIG. 10 illustrates a graph of electrical pulses according to the present invention.

With reference to FIG. 9, a distance determiner (e.g., an odometer) 91 includes first and second light sources 100, 102, respectively, and first and second light detectors 104, 106 (e.g., photocells), respectively, positioned near slots 110 in first and second plates 112, 114, respectively, along an axis 92 including the wheel 78. The distance determiner 91 acts to measure distance that the vehicle 28 travels. The plates 112, 114 are preferably positioned such that a slot 110 in the first plate 112 "leads" a slot 110 in the second plate 114 by about 1 degree, thereby forming a quadrature encoder.

With reference to FIGS. 1 and 8–10, electrical pulses 116, 118 are received by the detectors 104, 106 when light from the sources 100, 102 passes through the slots 110 in the respective plates 112, 114. The space between each of the slots 110 is known. Furthermore, each of the plates 112, 114 rotates as a function of the distance the vehicle travels. As indicated by the dotted lines in FIG. 10, the pulses 116, 118 are out-of-phase by about 1 degree. The electrical pulses 116, 118 are transmitted from the detectors 104, 106 to the computing device 42, which determines the distance the vehicle 28 has moved as a function of the number of pulses produced. Also, the direction in which the vehicle 28 is moving is determined by whether the phase of the first plate 112 leads/lags the phase of the second plate 114.

The distance is preferably determined in one of two ways. The distance determiner 91 requires the vehicle 28 to start at, and proceed from, a known location. For example, the vehicle 28 may proceed between two (2) "mile-posts." Alternatively, a differentially corrected global positioning system ("GPS") is used with vehicles where manual intervention is not available. More specifically, the position of the vehicle 28 is obtained from the GPS. Then, the distance determiner 91 is used to update the position of the vehicle 28 between the GPS transmissions (e.g., if the vehicle is in a tunnel).

A cellular modem is optionally used in the vehicle to automatically update a data bank of known defects. More specifically, as the vehicle moves around a geographic area (e.g., North America), the data bank collects defect information. Then, the information is transmitted (uploaded) to a main computer via the cellular modem and/or a cellular call.

Figure 11:
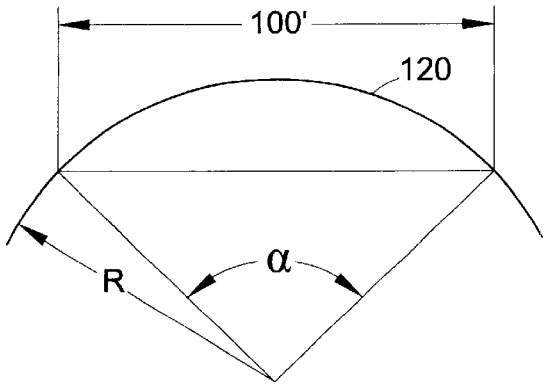
FIG. 11 illustrates a chord according to the present invention.

With reference to FIGS. 1 and 11, a degree-of-curve is defined as an angle a subtended by a chord 120 (e.g., 100 foot). The distance determiner discussed above is used to calculate the chord 120 distance. Also, the rate gyro and speed determiner discussed above are used to determine the degree-of-curve. More specifically, the rate gyro 50 (see FIG. 4) and the speed determiner 70 (see FIG. 6) may determine a certain rate in degrees/foot. That rate is then multiplied by the length of the chord 120 (e.g., 100 feet), which results in the degree-of-curve. The degree-of-curve represents a "severity" of a particular curve in the track 10.

Figure 12:
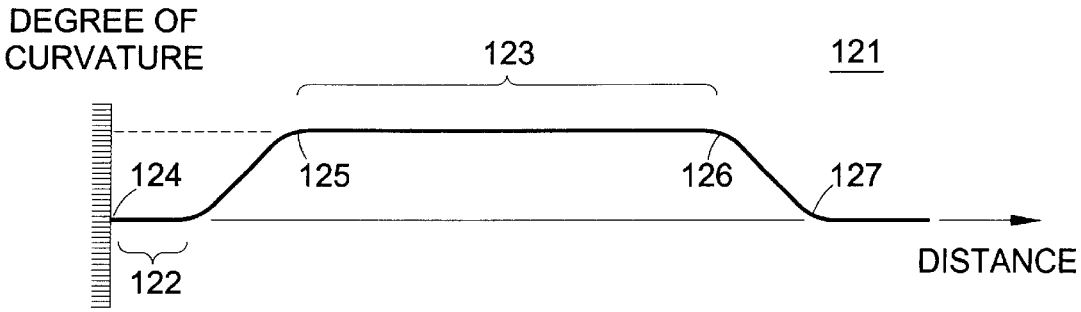
FIG. 12 illustrates a graph of degree-of-curvature versus distance according to the present invention.

FIG. 12 represents a graph 121 of degree-of-curvature versus distance. As a vehicle enters/exits a curve in a track (see, for example, FIG. 5), the degree-of-curvature changes. While the vehicle is on straight track (e.g., a tangent) or in the body of a curve having a constant radius, the degree-of-curvature remains about constant 122, 123, respectively. A point 124 represents a beginning of an entry spiral; a point 125 represents an end of the entry spiral/beginning of a curve; a point 126 represents an end of the curve/beginning of an exit spiral; and a point 127 represents an end of the exit spiral. The entry and exit spirals represent transition points between straight track and the body of a curve, respectively. Determining whether the vehicle is on a straight track (tangent), a spiral, or a curve is important for determining what calculations will be performed below.

Data representing engineering standards for taking corrective actions may be pre-loaded into a look-up table stored in a memory included in the computing device. The following corrective actions, for example, may be identified:

1) Safety Tolerances that, when exceeded, identify urgent defects (UD1) that must be attended to substantially immediately;
2) Maintenance Tolerances that, when exceeded, identify priority defects (PD1) that may be attended to at a later maintenance servicing;
3) Curve Elevation Tolerances (CET) that, when exceeded, identify potentially unsafe curve elevations; and
4) Maximum Allowance Runoff (MAR) Tolerances that, when exceeded, identify potentially unsafe uniform rise/falls in both rails over a given distance.

The defects discussed above are typically classified into at least two (2) categories (e.g., priority or urgent). Priority defects identify when corrective actions may be implemented on a planned basis (e.g., during a scheduled maintenance servicing). Urgent defects identify when corrective actions must be taken substantially immediately.

It is to be understood that it is also contemplated to store other parameters relating to the vehicle and/or track in the look-up table in alternate embodiments.

As discussed above, tangents are identified as straight track. Curves correspond to a body of a curve, i.e., the constant radius portion of a curve. Warp-in-tangents and curves are calculated as a maximum difference in cross-level along a length of track (e.g., 62' of track) while in a tangent section or a curve section. This calculation is made as the vehicle moves along the track. This calculated parameter is then compared to the data (e.g., engineering tables) discussed above, which is preferably stored in the look-up tables. A determination is made as to whether the current section of the track is within specification. If the section of track is identified as not being within specification, a message is produced and the offending data is noted in an exception file.

Warp in spirals are calculated as a difference in cross-level between any two points along a length of track (e.g., 31' of track) in a spiral. The data is also calculated as the car moves along the track. This calculated parameter is compared to the data stored in the look-up tables for determining whether the section of track under inspection is within specification. If the section of track is identified as not being within specification, a message is produced and the offending data is noted in the exception file.

A calculation is also made for determining cross-level alignment from design parameters at a particular speed. More specifically, this calculation determines a deviation from a specified design alignment. If an alignment deviation is found, it is noted in the exception file and the system calculates a new recommended speed, which would put the track back within design specifications.

A rate of runoff in spirals calculation, which determines a change in grade or rate of runoff associated with the entry and exit spirals of curves, is also performed. The rate of runoff in spirals calculation is performed over a running section of track (e.g., 10') and is compared to design data at a given speed for that section of track. If the rate of runoff is found to exceed design specifications, the fault is noted in the exception file, and a new, slower speed is calculated for the given condition.

Also, a frost heave or hole detector is optionally calculated. The frost heave or hole detector looks for holes (e.g., dips) and/or humps in the track. The holes and humps are longer wavelength features associated with frost heave conditions and/or sinking ballasts.

The system also performs a calculation for detecting a harmonic roll. Harmonic rolls cause a rail car to oscillate side to side. A harmonic roll, known as rock-and-roll, is associated with the replacement of a jointed rail with continuously welded rails ("CWR") for a ballast which previously had a jointed rail. The ballast retains a "memory" of where the joints had been and, therefore, has a tendency to sink at that location. This calculation for detecting harmonic rolls identifies periodic side oscillations associated in a particular section of track.

All the raw data described above is logged to a file. All spirals and curves are logged to a separate file. All out-of-specification particulars are logged to a separate file. All system operations or exceptions are also logged to a separate date file.

All of the data is preferably available for substantially real-time viewing (see video display device or computer monitor 142 in FIG. 14) in the vehicle. Because of the time required to process the data, the substantially real-time information appearing on the monitor typically reflects track/vehicle conditions approximately 100' to approximately 6,000' behind the vehicle.

Figure 13:
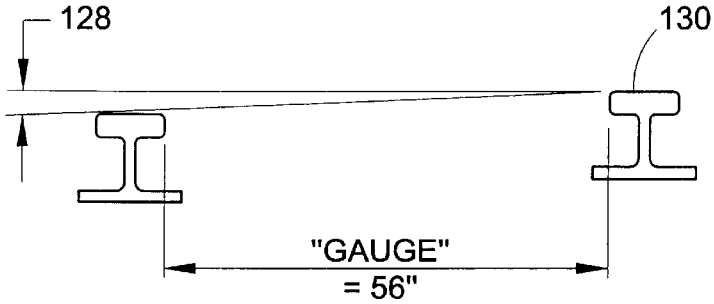
FIG. 13 illustrates a cross-level for a track according to the present invention.

FIG. 13 illustrates a cross-level 128 for a track 130. Cross-level for tangent (straight) track is typically about zero (0). Allowable deviations of the cross-level are obtained from the data describing Safety Tolerances in the look-up table.

The variations in the cross-level are related to speed. The designation is the "legal freight speed" for a section of track. This designation is defined in another set of tables, which relate freight speed to actual track position (mileage). Therefore, the system is able to determine the distance (mileage) and, therefore, looks-up the legal track speed for that specific point of track. The system is able to determine whether the vehicle is on tangent (straight) track, curved track, or spiral track from the graph shown in FIG. 12. An example of calculations for tangent (straight) track are discussed below.

To determine whether the vehicle is on tangent (straight) track, curved track, or spiral track, the system takes a snap-shot of all the parameters at one foot intervals, as triggered by the distance determiner. Therefore, the system performs such calculations every foot. The data are then statistically manipulated to improve the signal-to-noise ratio and eliminate signal aberrations caused by physical bumping or mechanical "noise." Furthermore, the data are optionally converted to engineering units.

More specifically, at a given time (or distance), if the vehicle is on a tangent (straight) track and traveling 40 mph with an actual cross elevation of 1⅛", the system first determines an allowable deviation, as a function of the speed at which the vehicle is moving, from the look-up table including data for urgent defects (UD1). For example, the allowable deviation may be 1½" at 40 mph. Since the actual cross elevation is 1⅛" and, therefore, less than 1½", the cross elevation is deemed to be within limits.

The system then looks-up a 1⅛" cross elevation in the priority defects table (PD1) as a function of the speed of the vehicle (e.g., 40 mph) and determines, for example, that an acceptable tolerance of 1" for cross elevation exists at 40mph. Because the actual cross elevation (e.g., 1⅛") is greater than the tolerance (e.g., 1"), the system records a priority defect for cross elevation from design.

If, on the other hand, the actual cross elevation is 1⅝", the system would first look-up the urgent defects table (UD1) at 40 mph to find, for example, that the allowable deviation is 1½". In this case, since the actual cross elevation is greater than the allowable cross elevation, the system would record an "urgent defect" of cross elevation from design. Because the priority standards are more relaxed than the urgent standards, the system would not proceed to the step of looking-up a priority defect.

Since an urgent defect was discovered, the system would then scan the urgent defects look-up table UD1 until a cross-level deviation greater than the current cross elevation is found. For example, the system may find that a speed of 30 mph would cause the urgent defect to be eliminated. Therefore, the system may issue a "slow order to 30 mph" to alert the operator of the vehicle to slow the vehicle down to 30 mph (from 40 mph, which may be the legal speed) to eliminate the urgent defect. If the deviation of the actual cross elevation from the tolerance is great (e.g., greater than 2½"), the a repair immediately condition will be identified.

From the rate gyro-speed determiner condition, the computing device determines when the vehicle is in a body of a curve. Therefore, when the vehicle is in the body of a curve, the system looks up the curve elevation for the legal speed from the curve elevation table. The system then looks up the allowable deviation from the urgent defects look-up table UD1 and determines the current cross elevation is less than or equal to: design cross elevation±allowable deviation for the cross elevation. If that condition is satisfied, the computing device determines that curve elevation is within tolerance. If that condition is not satisfied, the allowable deviation table is searched to find a vehicle speed that will bring the curve elevation table into tolerance. If such a value cannot be found, a repair immediately condition is identified.

The system described above is used as a real-time track inspection device. The system may be utilized by the track inspectors as part of their regular track inspection such that the system points out any track geometry abnormalities and recommends respective courses of action (e.g., immediately repair the track or slow down the car on a specific section of the track). The system accomplishes this task by comparing physical parameters of the track with the original design parameters combined with the allowed variances for that particular speed. These parameters are stored in design look-up tables stored within the computing device's memory. If the system identifies a particular section of track that is out of specification, the system identifies a speed that the car may safely travel on that track section.

The device disclosed in the present invention may be mounted in a locomotive rail car. As the locomotive car travels along the track, the device takes continuous readings. For example, the device measures the rail parameters, collects position information of the car along the track, determines out-of-specification rails, and/or stores the particulars of that defect in a memory device, preferably included within the computing device. The system then optionally detects an active cellular area, automatically makes a cellular telephone call and dumps the defect data into a central computer.

The device also notifies a train engineer that the car has run over an out-of-specification track. Furthermore, the system notifies the engineer to slow down the train to remain within safety limits.

In an alternate embodiment, it is contemplated to implement the device as a "Black Box" to record track conditions. Then, in the event of a derailment, the data could be used to identify the cause of the derailment. In this embodiment, the system would start, run, and shut-down with minimal human intervention.

The device of the present invention preferably includes an instrument box and a computer assembly. The instrument box is preferably mounted to a frame that accurately represents physical track characteristics. In this manner, the instrument box is subjected to an accurate representation of track movement. In the preferred embodiment, the frame is a Hirail track inspection truck. However, it is also contemplated that the frame be a locomotive.

The instrument box senses (picks-up) the geometry information and converts it so that it is suitable for processing by the computing device. The Hirail is also equipped with both a speed determiner and a distance determiner. In the Hirail configuration, the computing device is mounted in a convenient place. The driver of the vehicle is easily able to view the computer monitor when optionally notified by a "beeping" noise or, alternatively, a voice generated by the computer. If the frame is a locomotive, the computer is placed in a clean, convenient location.

The instrument box preferably includes the vertical gyroscope described above. The vertical gyroscope is used for both cross-level and grade measurements. The instrument box also includes a rate gyroscope, which, as described above, is used for detecting spirals and curves. A precision reference power supply and signal conditioning equipment are also preferably included in the instrument box.

Also, the computing device assembly preferably includes a data acquisition board, quadrature encoder board, a computer assembly, gyroscope power supplies, signal conditioning power supplies, and/or signal conditioning electronics. If the frame is an autonomous locomotive, additional equipment for a digital global positioning unit and a cellular data modem are also included.

Figure 14:
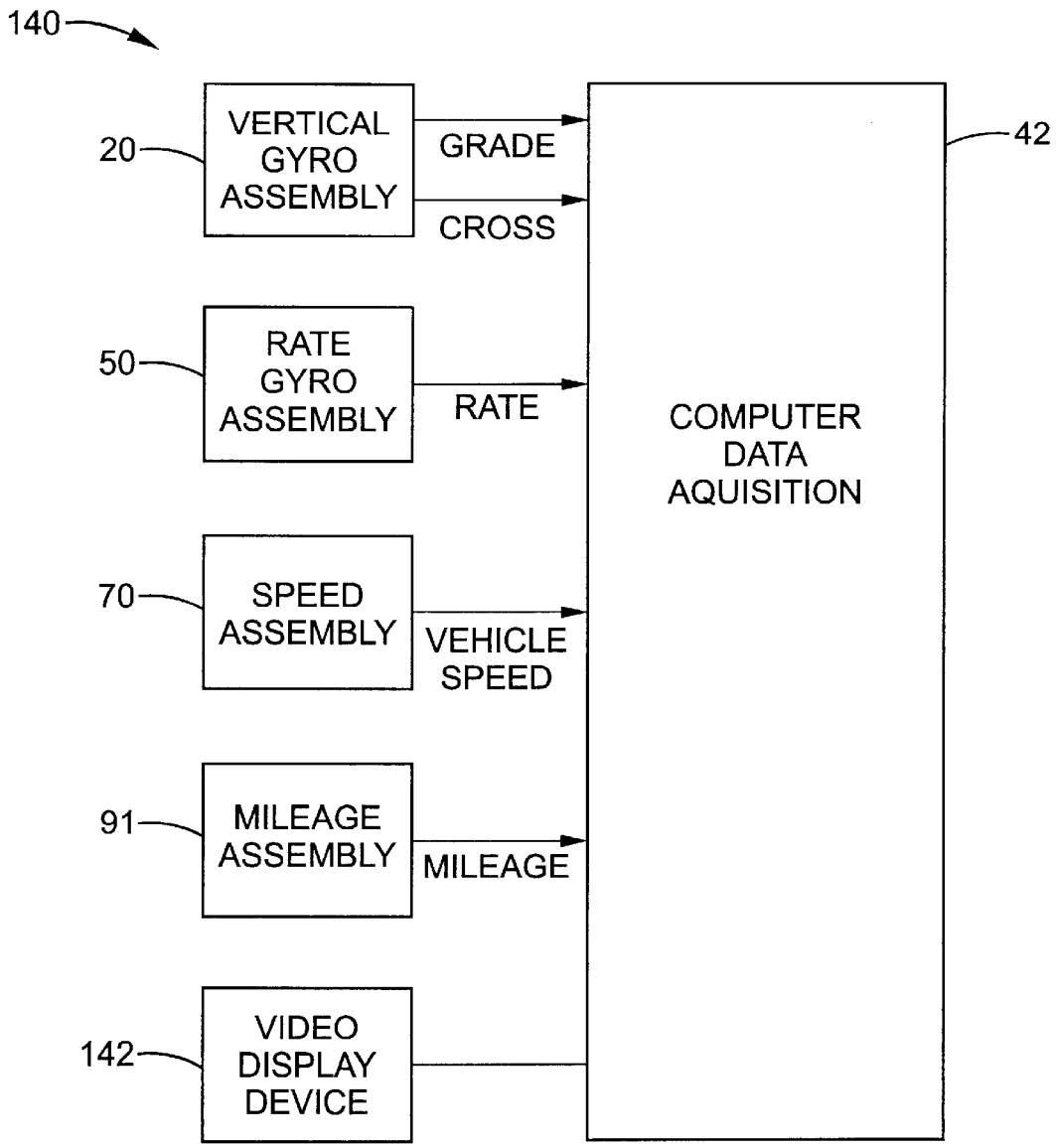
FIG. 14 illustrates a system according to the present invention.

FIG. 14 illustrates a system 140 for analyzing the track according to the present invention. The system includes the computing device 42, for receiving, storing, and processing data for inspecting rail track. The computing device 42 communicates with the vertical gyroscope 20 for receiving grade and cross information. The rate gyroscope assembly 50 supplies the computing device 42 with rate information. The speed assembly 70 supplies the computing device 42 with vehicle speed. The mileage assembly (odometer) 91 supplies the computing device 42 with mileage data. The computing device 42 processes the data received from the various components to determine the various conditions of the track discussed above. A video display device 142 displays the messages regarding the out of tolerance defects.

With reference to FIGS. 1 and 14, it is to be understood that the system 140 is mounted within the vehicle 28.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A track analyzer included on a vehicle traveling on a track, the track analyzer comprising:

a vertical gyroscope for determining a grade and an elevation of the track;

a rate gyroscope for determining a curvature of the track;

a speed determiner for determining a speed of the vehicle relative to the track;

a distance determiner for determining a distance the vehicle has traveled along the track; and a computing device, communicating with the vertical gyroscope, the rate gyroscope, the speed determiner, and the distance determiner, for a) identifying a plurality of parameters as a function of the grade, elevation, and curvature of the track, b) determining in real-time if the parameters are within acceptable tolerances, and, c) if the parameters are not within the acceptable tolerances, generating corrective measures.

2. The track analyzer as set forth in claim 1, further including:

a video display device communicating with the computing device, the corrective measures including messages displayed on the video display device.

3. The track analyzer as set forth in claim 1, further including:

an analog-to-digital converter for converting analog signals from the vertical gyroscope, the rate gyroscope, the speed determiner, and the distance determiner into respective digital signals which are transmitted to the computing device.

4. The track analyzer as set forth in claim 1, wherein the vertical gyroscope includes:

an inner gimbal;

an outer gimbal; and a spin motor creating an inertial force, the grade and the elevation of the track being determined by motions of the inner and outer gimbals against the inertial force.

5. The track analyzer as set forth in claim 4, wherein:

the inner gimbal determines the grade of the track; and the outer gimbal determines the elevation of the track.

6. The track analyzer as set forth in claim 1, further including:

a look-up table, communicating with the computing device, for storing the acceptable tolerances.

7. The track analyzer as set forth in claim 6, wherein:

the acceptable tolerances identify urgent defects and priority defects;

the corrective measures include actions to be implemented substantially immediately for urgent defects; and the corrective measures include actions to not be implemented substantially immediately for priority defects.

8. The track analyzer as set forth in claim 6, wherein the acceptable tolerances include curve elevation tolerances and maximum allowable runoff tolerances.

9. The track analyzer as set forth in claim 1, wherein the speed determiner includes:

a toothed gear having teeth passing a sensor for inducing a voltage in a coil, a frequency of the voltage being proportional to a speed of the vehicle relative to the track.

10. A method for analyzing a track on which a vehicle is traveling, comprising:

determining a grade and an elevation of the track;

determining a curvature of the track;

determining a speed of the vehicle relative to the track;

determining a distance the vehicle has traveled along the track;

identifying a plurality of parameters as a function of the grade, elevation, and curvature of the track;

determining in real-time if the parameters are within acceptable tolerances; and if the parameters are not within the acceptable tolerances, generating corrective measures.

11. The method for analyzing a track on which a vehicle is traveling as set forth in claim 10, further including:

displaying the corrective measures on a video display device.

12. The method for analyzing a track on which a vehicle is traveling as set forth in claim 10, further including:

an inner gimbal for determining the grade;

an outer gimbal for determining the elevation; and a spin motor creating an inertial force, the grade and the elevation of the track being determined by motions of the inner and outer gimbals against the inertial force.

13. The method for analyzing a track on which a vehicle is traveling as set forth in claim 10, further including:

accessing the acceptable tolerances from a look-up table.

14. The method for analyzing a track on which a vehicle is traveling as set forth in claim 13, wherein the acceptable tolerances identify urgent defects and priority defects, further including:

identifying the corrective measures as actions to be implemented substantially immediately for urgent defects; and identifying the corrective measures as actions to not be implemented substantially immediately for priority defects.

15. The method for analyzing a track on which a vehicle is traveling as set forth in claim 13, wherein the step of accessing the acceptable tolerances includes:

accessing acceptable curve elevation tolerances and acceptable maximum allowable runoff tolerances.

16. The method for analyzing a track on which a vehicle is traveling as set forth in claim 10, wherein the step of determining the distance includes:

producing light from a first source;

passing the light through a plurality of slots in a first plate which rotates as a function of the distance the vehicle travels relative to the track, a spacing between the slots being known;

producing first electrical pulses when light from the first source passes through the slots and is received by a first detector; and determining the distance the vehicle has traveled along the track as a function of a number of the first pulses received by the first detector.

17. The method for analyzing a track on which a vehicle is traveling as set forth in claim 16, further including:

producing light from a second source;

passing the light from the first and second sources through a plurality of slots in a the first plate and a second plate, respectively, which rotate as a function of the distance the vehicle travels relative to the track, the slots in the first plate being offset a predetermined amount from the slots in the second plate;

producing second electrical pulses when light from the second source passes through the slots and is received by a second detector; and determining a direction the vehicle is traveling along the track as a function of the first and second electrical pulses.

* * * * *